United States Patent [19]

Sasamori

[11] Patent Number: 4,829,150

[45] Date of Patent: May 9, 1989

[54] GAS-BLAST LOAD-BREAK SWITCH

[75] Inventor: Kenzi Sasamori, Amagasaki, Japan

[73] Assignee: Mitsubishi Denki Kabushiki Kaisha, Tokyo, Japan

[21] Appl. No.: 159,952

[22] Filed: Feb. 24, 1988

[30] Foreign Application Priority Data

Feb. 26, 1987 [JP] Japan ..... 62-43420

[51] Int. Cl.[4] ..... H01H 33/88

[52] U.S. Cl. ..... 200/148 A; 200/148 R

[58] Field of Search ..... 200/148 A

[56] References Cited

U.S. PATENT DOCUMENTS

| | | | |
|---|---|---|---|
| 3,769,479 | 10/1973 | Leeds | 200/148 A |
| 4,163,131 | 7/1979 | Perkins | 200/148 A |
| 4,256,940 | 3/1981 | Kii | 200/148 R |
| 4,276,456 | 6/1981 | Cromer et al. | 200/148 A |
| 4,475,018 | 10/1984 | Arimoto et al. | 200/148 A |
| 4,489,226 | 12/1984 | Holgren et al. | 200/148 A |
| 4,565,911 | 1/1986 | Slamecka | 200/148 A |

FOREIGN PATENT DOCUMENTS

| | | |
|---|---|---|
| 2943386 | 4/1980 | Fed. Rep. of Germany . |
| 49205 | 12/1938 | France . |
| 1322238 | 2/1963 | France . |
| 53-133771 | 11/1978 | Japan . |

*Primary Examiner*—Robert S. Macon

*Attorney, Agent, or Firm*—Lowe, Price, LeBlanc, Becker & Shur

[57] ABSTRACT

In a gas-blast load-break switch, a nozzle is formed to have a cylindrical trunk part (21*b*) and a bottom part (21*b*); the cylindrical trunk part has a predetermined inner diameter large enough to withstand a recovery voltage generated between the fixed arc contact and a movable arc contact in breaking current, so that an inner surface of the nozzle is isolated from the arc space and undesirable discharge to the nozzle, flashover through the nozzle and/or reignition outside the nozzle are prevented.

4 Claims, 6 Drawing Sheets

GAS-BLASK LOAD-BREAK SWITCH

FIELD OF THE INVENTION

The present invention relates to a gas-blast load-break switch in which an insulation gas extinguishes an arc to break the current as a load disconnecting switch or a gas-blast circuit breaker is operated.

DESCRIPTION OF THE RELATED ART

FIG. 5 is a cross-sectional view showing the conventional puffer type gas-blast load-break switch disclosed in the Japanese published patent application Sho No. 53-133771, and FIGS. 6 and 7 are enlarged partial cross-sectional views of FIG. 5 at different times during a current-breaking operation thereof. In FIG. 5, a fixed side shield 3 which is held by a first insulation spacer 2 is provided extending into the upper side of a cylindrical gas-tight grounded tank 1. A second insulation spacer 4 which is provided at the middle part of the grounded tank 1 is connected to a movable side shield 6 via a connector 5. The movable side shield 6 is fixed to a supporter 8, which is held by an insulation cylinder 7. A piston 9 which is one member of insulation gas supply unit is fixed on the supporter 8. A cylinder 10 is provided around the piston 9 in a manner slidable thereon in an up-down direction of the figure, and a puffer chamber 11 is formed by a space sectioned by the cylinder 10 and the piston 9. A fixed finger 12 with a lower end fixed to the piston 9 is provided around the cylinder 10, and the cylinder 10 is slidable in the up-down direction against the fixed finger 12. A cylindrical piston rod 13 having a through-passage therein is inserted slidably into the center of the piston 9 and is upwardly projected out of the cylinder 10.

The insulation gas supply unit comprises the piston 9, the cylinder 10, the fixed finger 12 and the piston rod 13.

The piston rod 13 has a movable arc contact 15 on an upper end thereof for connecting to a fixed arc contact 16 fixed by its upper end to the fixed side shield 3. The movable arc contact 15 is disposed on the same axis as the fixed arc contact 16. A nozzle 17 which is made of an insulating material is screwed into the shield 14, which is fixed on the cylinder 10, in a manner such as to surround a lower end of the fixed arc contact 16 and the movable arc contact 15 with a given gap inbetween. An inner surface of this nozzle 17 is formed so that arc-extinguishing insulation gas 19 is conducted to arc 18 which is formed between the fixed arc contact 16 and the movable arc contact 15 at the time of current-breaking.

Operation of the above-mentioned puffer type gas-blast load-break switch follows. When this gas-blast load-break switch is to break a load current, for instance to break the load current of a reactor (not shown) from a closed state such that an inner surface of the movable arc contact 15 is engaging with an outer surface of the fixed arc contact 16, the insulating rod 20 is lowered therefor. Along with the lowering of the insulating rod 20, the movable arc contact 15, the nozzle 17 and the cylinder 10 are all also lowered, respectively. Consequently, the movable arc contact 15 is disconnected from the fixed arc contact 16, and arc 18 is formed between the movable arc contact 15 and the fixed arc contact 16. At that time, the insulation gas 19 compressed by the movement of cylinder 10 with respect to piston 9 is conducted to an inner space of the nozzle 17. Thereafter the insulation gas 19 branches out into two passages, upwards toward the fixed arc contact 16 and downwards into the central hole of the piston rod 13 as shown by arrows in FIG. 6. The arc 18 is extinguished mainly by cooling the effect of the insulation gas 19 blasted thereto.

In breaking the current for a reactor, at the moment of breaking, a recovery voltage has one is impressed across the movable arc contact 15 and the fixed arc contact 16. This recovery voltage has one hundred and dozens micro seconds duration of wave front and has about "2E" (E is the normal negative peak value of voltage to ground) peak voltage. Therefore, though the insulation gas supply unit blasts the insulation gas 19 as described, reignitions are repeated between the movable arc contact 15 and the fixed arc contact 16. When the insulation between the movable arc contact 15 and the fixed arc contact 16 becomes able to withstand the recovery voltage corresponding to the aforementioned "2E", interruption of current is completed.

FIG. 8 is a graph showing a relation between an inter-pole distance and a flashover voltage of the conventional gas-blast load-break switch, wherein a curve I which shows the relation between the movable arc contact 15 (FIG. 6) and the fixed arc contact 16 (FIG. 6) is represented at some inter-pole distances by plotting averages of scatterings "A" of the reignition voltages at the time of current-breaking. Another curve II shows a relation of the flashover voltage, which causes flashover and hence forms an arc 30 between the fixed side shield 3 outside the nozzle 17 and the shield 14 as shown in FIG. 5, versus the inter-pole distance thereof. Since there are no gas-flows of the insulation gas 19 outside the nozzle 17, once the flashover occurs the arc 30 cannot be extinguished by this gas-blast load-break switch. Therefore, to avoid such a state, the puffer type gas-blast load-break switch is designed so that the curve II has higher flashover voltages than the highest scatterings of those of the curve I, which shows the relation between the inter-pole distance and the flashover voltage inside the nozzle 17, at the same inter-pole distances.

However, in the above-mentioned conventional puffer type gas-blast load-break switch, when the reignition occurs as shown in FIG. 7, a disposition such that an inner surface of the nozzle 17 comes close to an arc space between the fixed arc contact 16 and the movable arc contact 15 brings an undesirable creeping discharge (flashover) 31 along the inner surface of the nozzle 17, and a tracking which leads to deterioration of insulation is made thereon. Once the tracking is made on the nozzle 17, the scatterings "A" of the flashover voltage in the curve I of FIG. 8 become large, and thereby the flashover voltages represented by the curve II comes within the region of the scatterings "A" of the curve I. Then the flashover (making the arc 30 of FIG. 5) occurs with a certain probability, and thereby induces a state such that the current cannot be interrupted. Furthermore, as shown in FIG. 7, since the nozzle 17 is exposed in a high potential field, a flashover (making an arc 32) through the nozzle 17 occurs between the fixed arc contact 16 and the shield 14. As a result, the arc 18 flows to the shield 14 which is disposed apart from gas-flows of the insulation gas 19, thereby inducing a state such that the current cannot be interrupted.

OBJECT AND SUMMARY OF THE INVENTION

The object of the present invention is to offer an improved gas-blast load-break switch which is capable of preventing the creeping discharge on the nozzle, flashover through the nozzle and the reignition outside the nozzle thereby achieving an excellent current-breaking ability.

In order to achieve the above-mentioned object, a gas-blast load-break switch in accordance with a preferred embodiment of the present invention comprises:

A gas-tight tank, a fixed arc contact fixed in the tank, a movable arc contact which is held in the tank to be movable on the same axis as an axis of the fixed arc contact, for selectively connecting and disconnecting with the fixed arc contact, insulation gas supply means which is held in the tank for blasting an insulation gas to an arc which is formed by disconnecting the fixed arc contact from the movable arc contact, and a nozzle which is held in the tank for conducting the insulation gas and is formed by a cylindrical trunk part having an inner diameter of a predetermined size sufficient to withstand a recovery voltage generated between the fixed arc contact and the movable arc contact during the breaking of a current therebetween and an end part having a hole of a diameter smaller than said inner diameter and larger than said fixed arc contact in a direction transverse to said axis for surrounding the fixed arc contact, to said hole diameter being small enough to prevent any arcing between the inner surface of said trunk part and said fixed contact during said current break to by isolating an inner surface of the nozzle from an arc space between the fixed arc contact and the movable arc contact.

By adopting the above-mentioned construction, the inner surface of the nozzle is isolated from the arc space formed between the fixed arc contact and the movable arc contact. Thereby, the creeping discharge on the nozzle, flashover through the nozzle and/or the reignition outside the nozzle is prevented, and thereby the breaking ability can be improved.

DESCRIPTION OF THE PREFERRED EMBODIMENT

The, preferred embodiment of the present invention is described with reference to the accompanying drawings.

Figure 1:
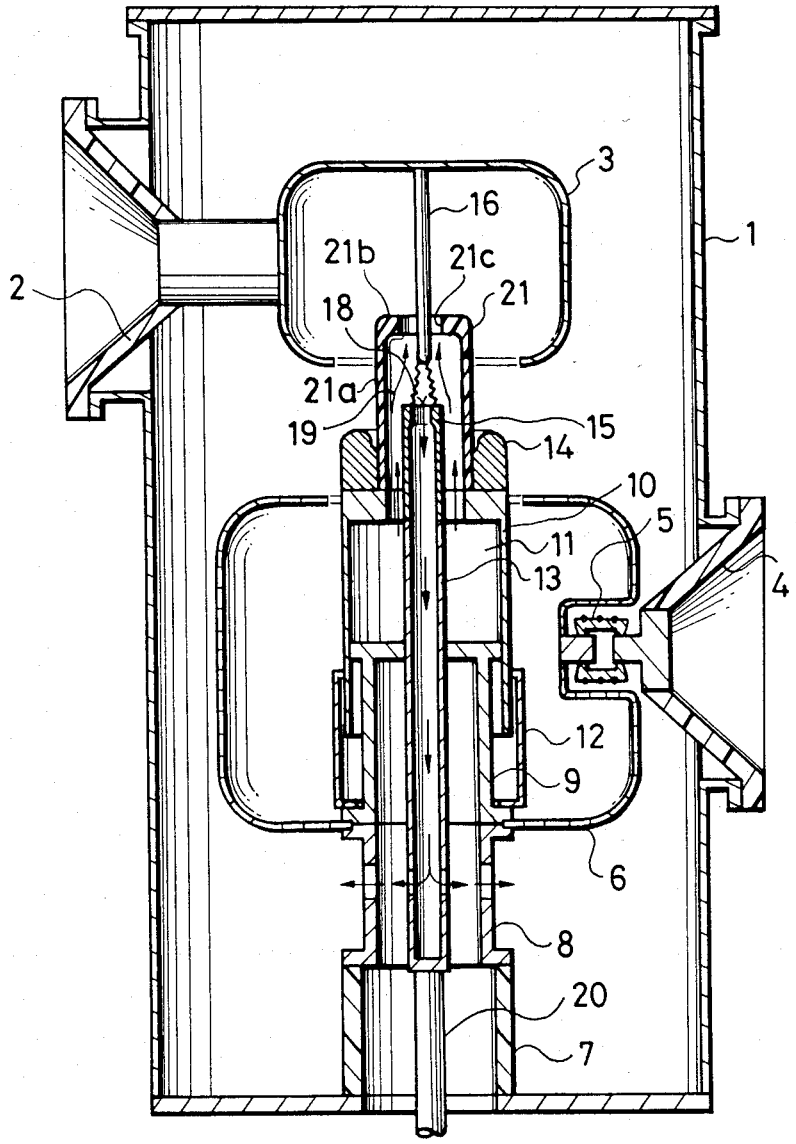
FIG. 1 is a cross-sectional view showing an embodiment of a puffer type gas-blast load-break switch in accordance with the present invention.
Figure 2:
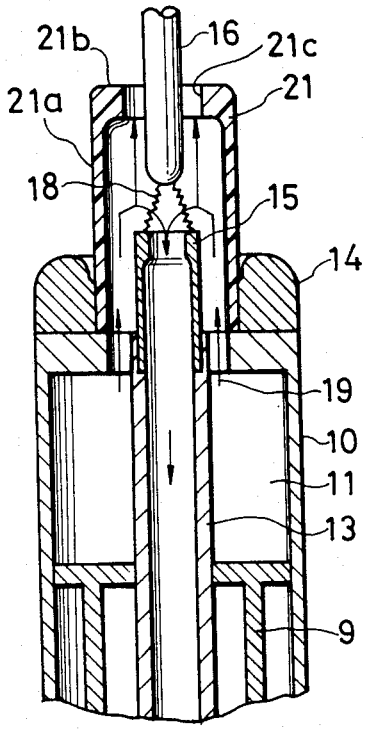
FIG. 2 is an enlarged partial cross-sectional view of FIG. 1 at the time of current-breaking.
Figure 3:
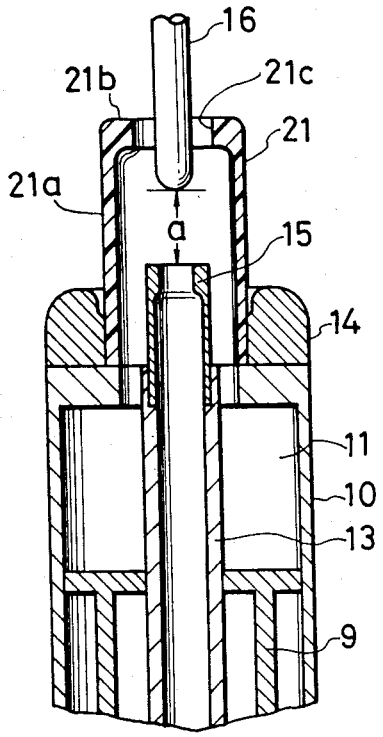
FIG. 3 is an enlarged partial cross-sectional view of FIG. 1 after breaking current.

FIG. 1 is a cross-sectional view showing preferred embodiment of the puffer type gas-blast load-break switch according to this invention. FIGS. 2 and 3 are an enlarged partial cross-sectional views of FIG. 1 at the time of current-breaking and after breaking current, respectively. In FIG. 1, a fixed side shield 3 which is held by a first insulation spacer 2 is provided at the inside of the upper side of a cylindrical gas-tight earthed tank 1. A second insulation spacer 4 which is provided at the middle part of the grounded tank 1 is connected to a movable side shield 6 via a connector 5. The movable side shield 6 is fixed to a supporter 8, which is held by an insulation cylinder 7. A piston 9 which is one member of an insulation gas supply unit is fixed on the supporter 8. A cylinder 10 is provided around the piston 9 in a manner slidable thereon in an up-down direction as seen in the figure, and a puffer chamber 11 is formed by a space sectioned by the cylinder 10 and the piston 9. A fixed finger 12 a lower end of which is fixed to the piston 9 is provided around the cylinder 10, and the cylinder 10 is slidable in the up-down direction against the fixed finger 12. A cylindrical piston rod 13 having a through-passage therein is inserted slidably into the center of the piston 9 and is upwardly projected out of the cylinder 10.

The insulation gas supply unit comprises the piston 9, the cylinder 10, the fixed finger 12 and the piston rod 13.

The piston rod 13 has a movable arc contact 15 on an upper end thereof for connecting to a fixed arc contact 16 fixed by its upper end to the fixed side shield 3. The movable arc contact 15 is disposed on the same axis as the fixed arc contact 16. A nozzle 21 which is made of an insulating material is screwed into the shield 14, which is fixed on the cylinder 10, in a manner such as to surround a lower end of the fixed arc contact 16 and the movable arc contact 15 with a given gap inbetween. An inner surface of this nozzle 21 is formed so that arc-extinguishing insulation gas 19 is conducted to arc 18 which is formed between the fixed arc contact 16 and the movable arc contact 15 at the time of current-breaking.

Operation of the above-mentioned puffer type gas-blast load-break switch embodying the present invention is now described. When this gas-blast load-break switch is to break a load current, for instance to break the load current of a reactor (not shown) from a closed state such that an inner surface of the movable arc contact 15 is engaging with an outer surface of the fixed arc contact 16, the insulating rod 20 is lowered therefor. Along with the lowering of the insulating rod 20, the movable arc contact 15, the nozzle 21 and the cylinder 10 are all also lowered, respectively. Consequently, the movable arc contact 15 is disconnected from the fixed arc contact 16, and the arc 18 is formed between the movable arc contact 15 and the fixed arc contact 16. At that time, the insulation gas 19 compressed by movement of piston 10 with respect to the piston 9 is conducted to an inner space of the nozzle 21. Thereafter, the insulation gas 19 branches out into two passages, upwards toward the fixed arc contact 16 and downwards into the central hole of the piston rod 13 as shown by arrows in FIG. 2. The arc 18 is extinguished mainly by the cooling effect of the insulation gas 19 blasted thereto.

In breaking the current for a reactor, at the moment of breaking, a recovery voltage is impressed across the movable arc contact 15 and the fixed arc contact 16. This recovery voltage has one hundred and dozens micro seconds duration of wave front and has about "2E" (E is the normal negative peak value of voltage to ground) peak voltage. Therefore, through the insulation gas supply unit blasts the insulation gas 19 as described, reignitions are repeated between the movable arc contact 15 and the fixed arc contact 16. When the insulation between the movable arc contact 15 and the fixed arc contact 16 comes to be able to withstand the recovery voltage corresponded to the aforementioned "2E", interruption of current is completed.

As shown in FIG. 2, the nozzle 21 has a cylindrical trunk part 21*a* and a bottom part 21*b* having a hole 21*c* thereon. An inner diameter of the cylindrical trunk part 21*a* is formed large up to a predetermined position so that the inner surface of the nozzle 21 can withstand an electric field of recovery voltage at the time of current-breaking between the fixed arc contact 16 and the movable arc contact 15, and an inner diameter of the hole 21*c* in the bottom part 21*b* is formed smaller than that of the cylindrical trunk part 21*a* in order to surround the fixed arc contact 16. The inner surface of the nozzle 21 is thus sufficiently isolated from an arc space between the fixed arc contact 16 and the movable arc contact 15.

In the above-mentioned puffer type gas-blast load-break switch, as shown in FIG. 2, since the inner surface of the nozzle 21 is isolated from the above-mentioned arc space at the time of current-breaking for the reactor, the arc 18 is formed only between the fixed arc contact 16 and the movable arc contact 15. After that, as shown in FIG. 3, an inter-pole distance "a" withstands the recovery voltage, and thereby interruption of current is completed.

Figure 4:
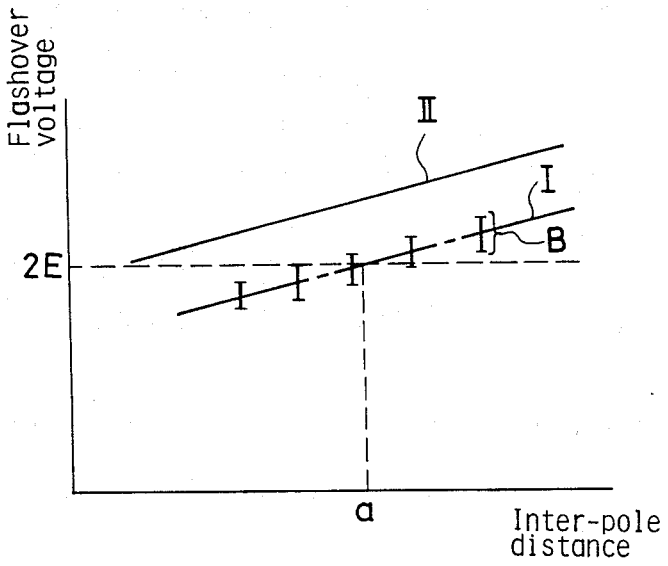
FIG. 4 is a graph showing relations between interpole distance and flashover voltage of the embodiment shown in FIG. 1.
Figure 5:
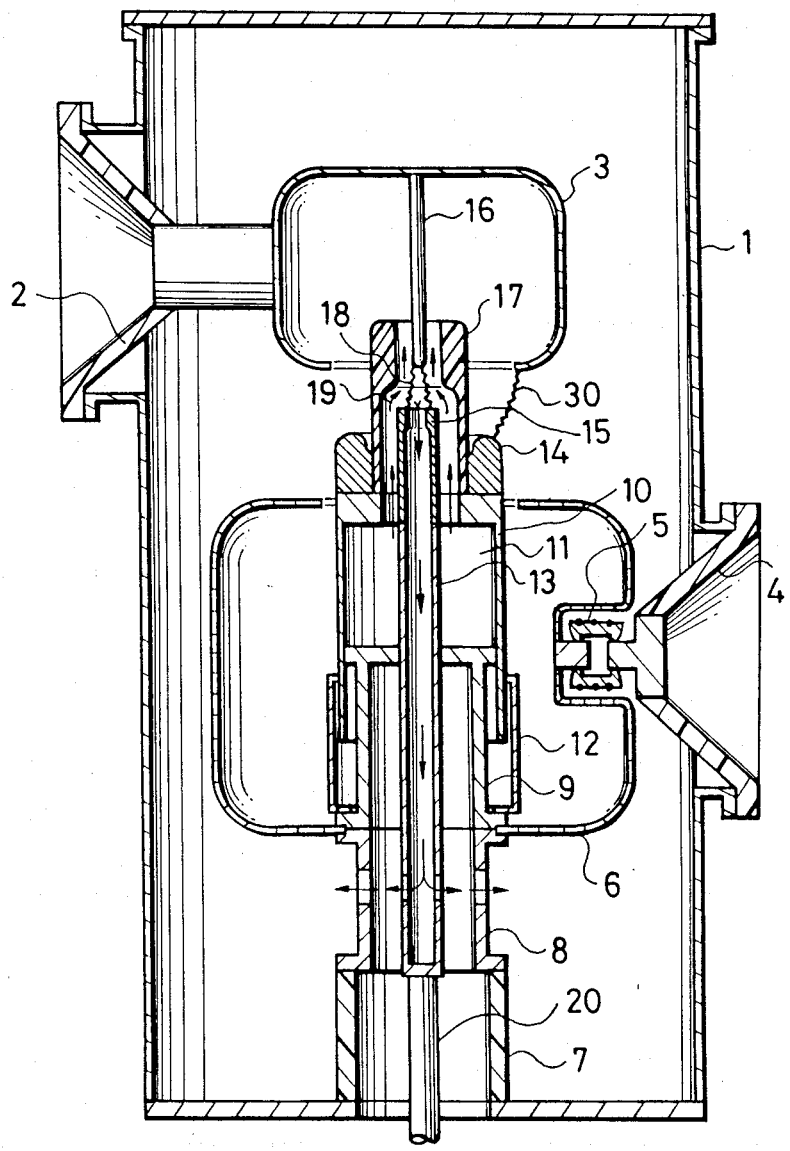
FIG. 5 (Prior Art)
FIG. 5 is the cross-sectional view showing the conventional puffer type gas-blast load-break switch.
Figure 6:
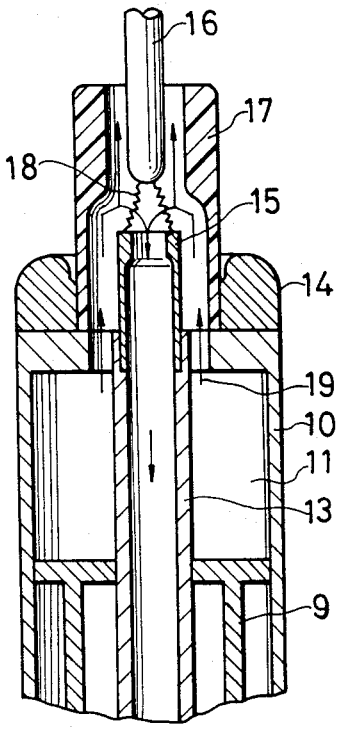
FIG.6 (Prior Art)
FIG. 6 is the enlarged partial cross-sectional view of FIG. 5 at the time of current-breaking.
Figure 7:
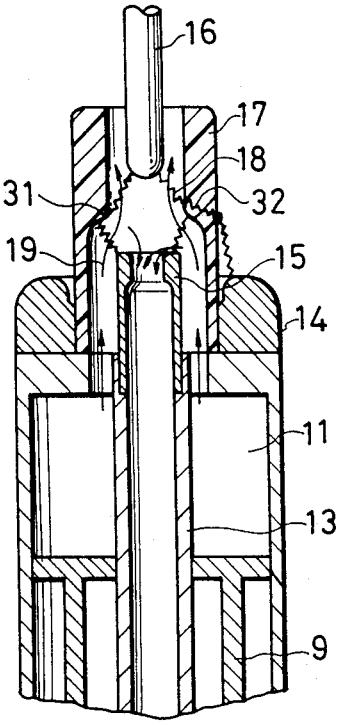
FIG.7 (Prior Art)
FIG. 7 is the partial enlarged cross-sectional view of FIG. 5 showing undesirable state of current-breaking.

FIG. 4 is a graph showing a relation between inter-pole distance and flashover voltage of the embodiment, wherein a curve I which shows the relation between the movable arc contact 15 (FIG. 2) and the fixed arc contact 16 (FIG. 2) is represented at some inter-pole distances by plotting averages of scatterings "B" of the reignition voltages at the time of current-breaking. Another curve II shows a relation of the flashover voltage, which makes flashover hence to form an arc 30 between the fixed side shield 3 outside the nozzle 17 and the shield 14 as shown in FIG. 1, versus the inter-pole distance thereof.

Figure 8:
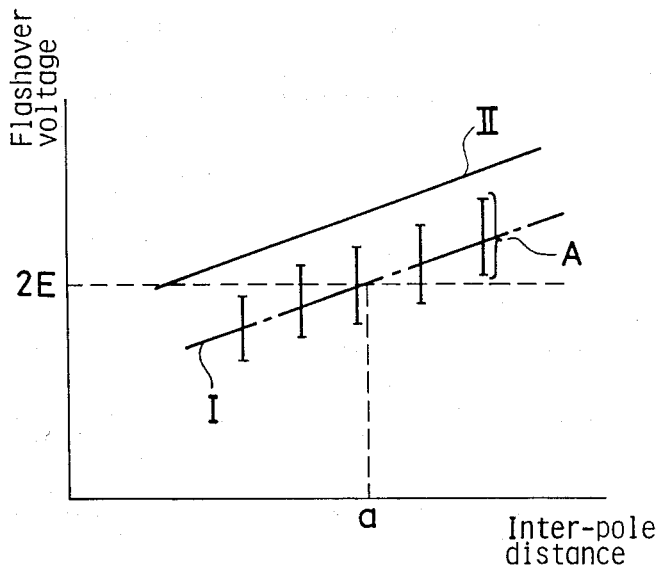
FIG 8 (Prior Art)
FIG. 8 is the graph showing relations between interpole distance and flashover voltage of the conventional puffer type gas-blast load-break switch shown in FIG. 5.

In comparison with FIG. 8, which shows the conventional relation between the inter-pole distance and the flashover voltage, FIG. 4 of the present invention clarifies that the scatterings "B" of the reignition voltages is smaller than the scatterings "A" of FIG. 8. Therefore, the maximum reignition voltage included in the maximum value of the scatterings "B" does not come above the curve II. That is, the reignitions occur only between the fixed arc contact 16 (FIG. 2) and the movable arc contact 15 (FIG. 2). In other words, no reignition occurs outside the nozzle 21 (FIG. 1) between the fixed side shield 3 (FIG. 1) and the shield 14 (FIG. 1).

While specific embodiments of the invention have been illustrated and described herein, it is realized that other modifications and changes will occur to those skilled in the art. It is therefore to be understood that the appended claims are intended to cover all modifications and changes as fall within the true spirit and scope of the invention.

What is claimed is:

1. A gas-blast load-break switch, comprising:

a gas-tight tank;

a fixed arc contact fixed in said tank;

a movable arc contact which is held in said tank to be movable on the same axis as an axis of said fixed arc contact, for selectively connecting and disconnecting with said fixed arc contact;

insulation gas supply means which is held in said tank for blasting an insulation gas to an arc which is formed by disconnecting said fixed arc contact from said movable arc contact; and a nozzle which is held in said tank for conducting said insulation gas and is formed by a cylindrical trunk part with an inner cylindrical surface having an inner diameter of a predetermined size sufficient to withstand a recovery voltage generated between said fixed arc contact and said movable arc contact during the breaking of a current therebetween and an end part having a hole of a diameter smaller than said inner diameter and larger than said fixed arc contact in a direction transverse to said axis for surrounding said fixed arc contact, said hole diameter being small enough to prevent any arcing between the inner cylindrical surface of said trunk part and said fixed contact during said current break by isolating an inner surface of the nozzle from an arc space between said fixed arc contact and said movable arc contact.

2. A gas-blast load-break switch in accordance with claim 1, wherein;

said nozzle is made of an insulating material.

3. A gas-blast load-break switch in accordance with claim 1, wherein;

said nozzle is coaxially disposed with respect to said axis and slides along said axis together with said movable arc contact.

4. A gas-blast load-break switch in accordance with claim 1, wherein;

an end of said fixed arc contact is projected within said nozzle through said hole.

* * * * *